US005540063A

United States Patent [19]

Ferrell

[11] Patent Number: 5,540,063

[45] Date of Patent: Jul. 30, 1996

[54] STOCKING

[75] Inventor: James Ferrell, Graham, N.C.

[73] Assignee: Allstate Hosiery Sales, Inc., New York, N.Y.

[21] Appl. No.: 441,327

[22] Filed: May 15, 1995

[51] Int. Cl.[6] ..... D04B 9/46

[52] U.S. Cl. ..... 66/172 E; 66/178 R; 66/200

[58] Field of Search ..... 66/172 A, 172 E, 66/178 R, 178 A, 188, 194, 198, 200

[56] References Cited

U.S. PATENT DOCUMENTS

| | | | |
|---|---|---|---|
| 2,102,369 | 12/1937 | Martel | 66/172 E |
| 2,157,464 | 5/1939 | Snader | 66/172 E |
| 2,977,782 | 4/1961 | Sheek | 66/178 R |
| 3,290,904 | 12/1966 | Snyder | 66/178 A |

FOREIGN PATENT DOCUMENTS

| | | | |
|---|---|---|---|
| 1718269 | 3/1956 | Germany | 66/172 E |
| 376017 | 10/1939 | Italy | 66/172 E |
| 1214797 | 2/1986 | U.S.S.R. | 66/200 |
| 2088420 | 6/1982 | United Kingdom | 66/172 E |

*Primary Examiner*—John J. Calvert

*Attorney, Agent, or Firm*—Brumbaugh, Graves, Donohue & Raymond

[57] ABSTRACT

A stocking has a top band composed of a 2×3 double rib band part knitted to the upper end of a single-ply 4×4 positive floater block pattern band part. The 2×3 feed is selected for feed 1 elastic yarns of the rib band part, and the 4×4 feed is selected for feeds 1 and 3 elastic yarns of the block pattern band part.

12 Claims, 3 Drawing Sheets

STOCKING

FIELD OF THE INVENTION

The present invention relates to improvements in ladies hosiery and, more particularly, to a stocking in which a top band portion that grips the wearer's leg and by which the stocking is kept from sliding down the wearer's leg is made more comfortable and healthier by making it less constrictive and binding without detracting from the holding power or the appearance of the stocking. The term "stocking" is used herein in a broad sense to include both full and partial length hose, full-fashioned hose and tube hose.

BACKGROUND OF THE INVENTION

Most stockings of the types referred to above are constructed with what is known as a Double Cuff Top or Band. Those top bands are usually formed with a 1×1 or 2×2 needle selection and with synthetic yarns such as nylon and "Lycra." The nylon yarns are mainly used to form the body of the top band. The "Lycra" yarns are used to give the constricting power to the top band. The combination of those yarns and stitches and the doubling over of the top band to form the Double Cuff Top tends to make the top band highly constrictive and binding to the leg. The highly constrictive Double Cuff Top causes discomfort and irritation to the skin, and also restricts the blood flow through the area of the leg that it engages, which can make the legs feel swollen and tired.

SUMMARY OF THE INVENTION

An object of the invention is to provide a stocking having a top band that is less constrictive and, therefore, more comfortable and that still retains its ability to stay in place on the wearer's leg rather than sipping down. Another object is to provide an stocking having a top band that is attractive in appearance, is easy to knit, and is less costly than Double Cuff Tops.

There is provided, according to the present invention, a knitted stocking having a top band composed of two circumferentially extending parts. In particular, a first part at the top end of the top band has a plurality of first courses of relatively less elastic yarns, the yarns in each first course forming needle loops in every wale, and a plurality of second courses of relatively more elastic yarns, the yarns in each second course forming alternately two needle loops in adjacent wales and three clear floaters in adjacent wales. There are, preferably, three first course between each adjacent pair of second courses, and the clear floaters of the second courses occur in the same wales, thus providing a ribbed effect. The second band has a plurality of third courses of relatively less elastic yarns, the yarns in each third course forming needle loops in every wale, and a plurality of fourth courses of relatively more elastic yarns, the yarns in each fourth course forming alternately four needle loops in adjacent wales and four positive floaters in adjacent wales. The third and fourth courses alternate such that a fourth course lies between each adjacent pair of third courses. The needle loops and positive floaters of the fourth courses form blocks of eight courses each in which the positive floaters in groups of adjacent fourth courses occur in the same wales. The blocks are staggered in a uniform checkerboard or waffle pattern in the coursewise direction. The first part of the band is doubled over, and the free end is stitched to the end of the first part adjacent the second part.

In other words, the first part is doubled, and the second part is single-ply.

In a preferred embodiment, the first part of the top band has a width of about ¾ inch and the second part a width of about 1¼ inch. The yarns of the first and third courses are textured nylon of about 70 denier, the yarns of the second courses are double-covered elastic yarns, and the yarns of the fourth courses are alternately from course to course double-covered elastic and single-covered elastic yarns. The single covered elastic yarns are, preferably, of a substantially lower denier than the double covered yarns. Suitable elastic yarns are "Spandex" and "Lycra."

In a particularly preferred construction, the top band of the present invention comprises at its end (the first part) a 2×3 double rib band of a width of about ¾ inch having in alternation three courses of nylon yarn forming knitted loops in every wale and a 2×3 course of double-covered elastic yarn having in alternation two knitted loops and three clear floaters, each group of three floaters being in the same wales, and 4×4 positive floater block pattern single ply band (the second part) of a width of about 1¼ inch knitted to the end band and having in alteration a course of nylon yarn forming knitted loops in every wale and a 4×4 course of covered elastic yarn forming in alternation four knitted loops and four positive floaters. The positive floaters form a uniform block pattern of blocks staggered coursewise in a waffle pattern, each block having four floaters in the same wales.

A cuff according to the present invention provides less constriction without loss of holding power by combining a double rib band with a single ply block pattern band. The top band may have about 20% fewer courses than a Double Cuff Top and thus uses about 20% less elastic yarn. The reduced content of elastic yarn correspondingly reduces the constrictive power. The reduction is the content of elastic yarn also reduces the cost. To compensate for the reduced constrictive power, the block pattern single ply band presents myriad small dimples in a checker board or waffle pattern that provide a good gripping action with the skin of the wearer. In addition, the floaters are exposed to the leg, which further assists in imparting holding power.

For a better understanding of the invention, reference may be made to the following description of an exemplary embodiment, taken in conjunction with the accompanying drawings.

DESCRIPTION OF THE EMBODIMENT

Figure 1:
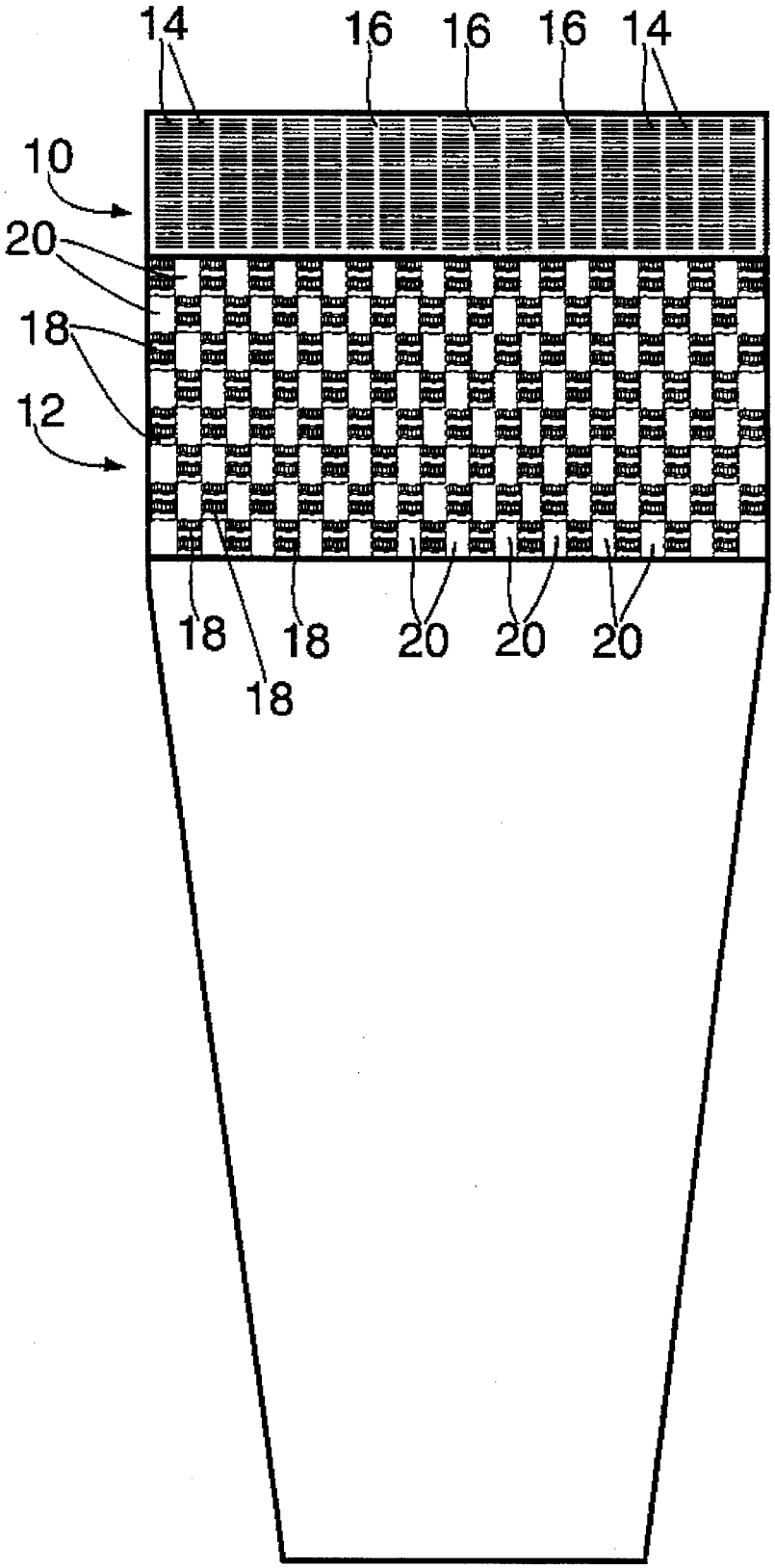
FIG. 1 is a schematic view of a stocking having a 2×3 double rib band part knitted to the upper end of a single-ply 4×4 positive floater block pattern band part.

The stocking shown in FIG. 1, which as described above may be a full or partial length stocking, a full-fashioned stocking or a tube stocking of any desired knitting construction, has a top band composed of a 2×3 double rib band part 10 knitted to the upper end of a single-ply 4×4 positive floater block pattern band part 12. The series of lines 14 in the part 10 represent ribs formed by groups of three wales in which every fourth course has a relatively more elastic yarn forming floaters in those wales. The clear bands 16 between the series of lines 14 represent pairs of adjacent wales in which there are knitted loops in every course. The shaded blocks 18 in the part 12 represent groups of four adjacent wales and eight adjacent courses in which every other course is a positive floater in those four wales formed by a relatively more elastic yarn and the remaining courses have knitted loops formed by relatively less elastic yarns. The parts 20 between the blocks 18 are groups of eight adjacent courses in four adjacent wales in which the yarns form knitted loops throughout.

Figure 2:
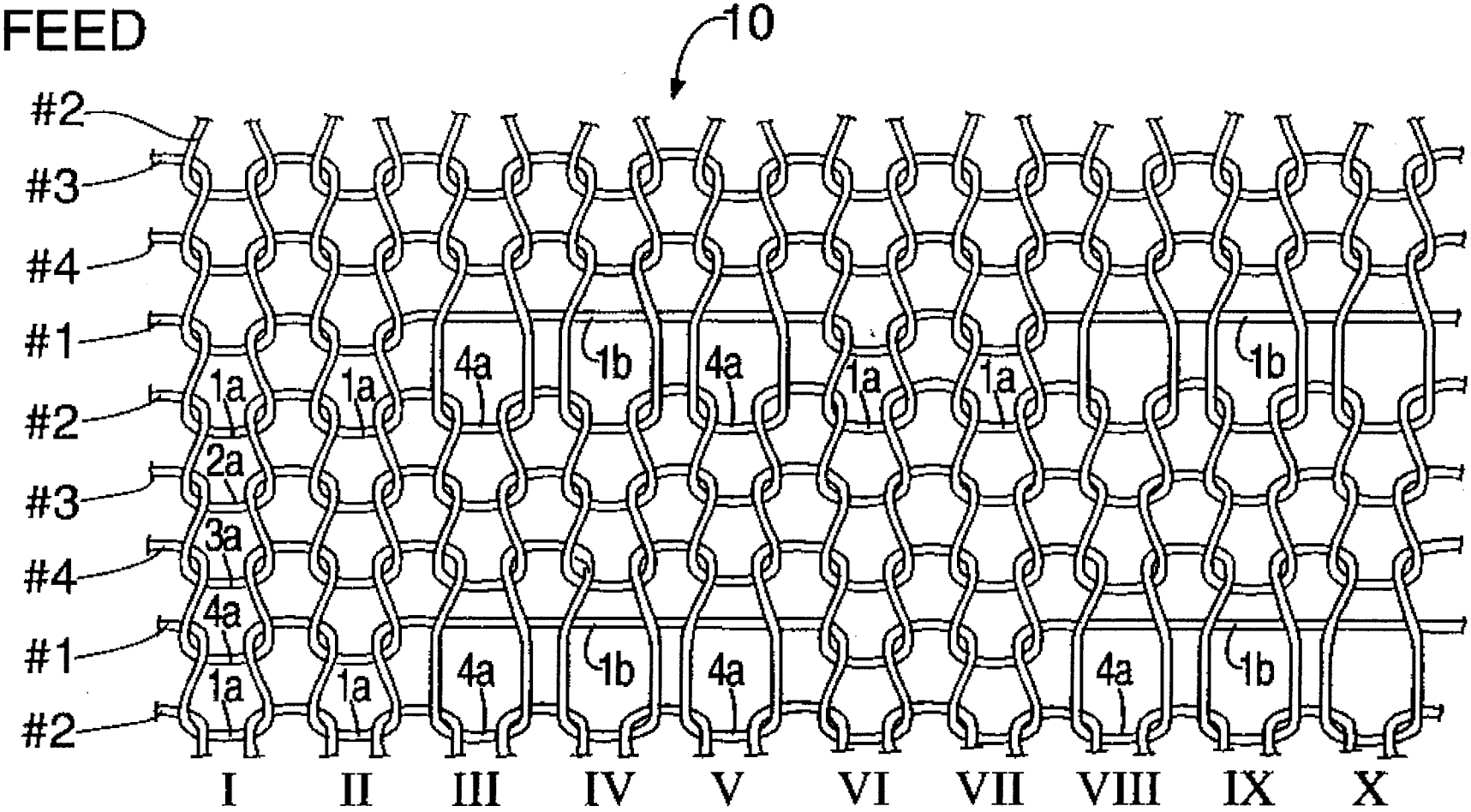
FIG. 2 is an enlarged view of a small section of 2×3 double rib band part.

The band part 10 (see FIG. 2), more particularly, consists of courses of relatively less elastic yarns #2, #3, and #4, such as nylon, that form knitted loops 2*a*, 3*a*, and 4*a* in very wale and courses #1 of relatively more elastic yarns, such as covered "Lycra," that form, alternately, knitted loops 1*a* in two adjacent wales and clear floaters 1*b* in three adjacent wales. (In this Specification and the drawings, the symbol "#" should be read as "feed," and represents a feed of a knitting machine. Thus, for example, in the drawing "#2" designates feed 2. Each feed also represents a course of the fabric. The wales of the fabric are designated in the drawings by capital Roman numerals, e.g., I, II, III.) All of the #1 yarns form clear floaters 1*b* in the same groups of three adjacent wales (e.g., wales III, IV and V and wales VIII, IX and X of FIG. 2). Because it takes less yarn to form the floaters 1*b*, the floaters 1*b* of yarns #1 gather the adjacent three wales in which they occur and produce the ribs 14 (FIG. 1). The ribs provide good adhesion to the wearer's skin. The elastic yarns provide the constrictive power needed to hold the stocking up on the wearer's leg.

Figure 3:
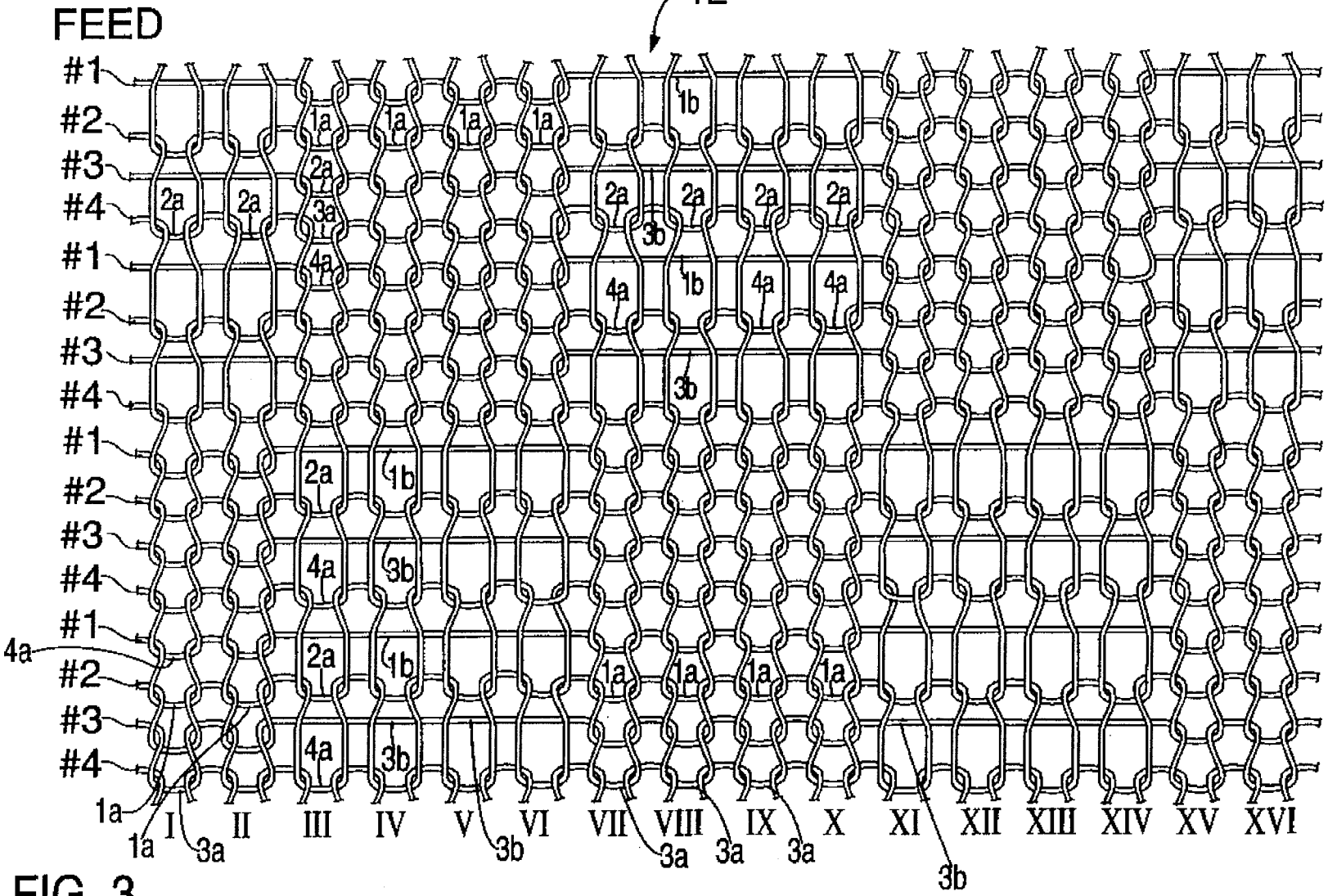
FIG. 3 is an enlarged view of a small section of the single-ply 4×4 positive floater block pattern part.

The single-ply 4×4 positive floater block pattern band part 12 (FIG. 3) of the stocking top band consists of alternate courses of relatively less elastic yarns #2 and #4 that form knitted loops 2*a* and 4*a* in very wale and courses #1 and #3 of relatively more elastic yarns that form, alternately, knitted loops 1*a* and 3*a* in four adjacent wales and positive floaters 1*b* and 3*b* in four adjacent wales. The block pattern is such that there are groups (unshaded blocks 20 of FIG. 1) of four adjacent wales and eight adjacent courses in which all of the yarns form knitted loops (e.g., the eight courses in the upper left part of FIG. 3 in wales III, IV, V and VI and the eight courses in the lower center part of FIG. 3 in wales VII, VIII, IX and X) and groups (shaded blocks 18 in FIG. 1) of four adjacent wales and eight adjacent courses in which the #1 and #3 yarns form positive floaters 1*b* and 3*b* in every wale and the #2 and #4 yarns form knitted loops 2*a* and 4*a* in every wale (e.g., the eight courses in the upper center part of FIG. 3 in wales VII, VIII, IX and X and the eight courses in the lower left part of FIG. 3 in wales III, IV, V and VI). The two groups of blocks 18 and 20 (those without #1 and #3 floaters and those with #1 and #3 floaters) are staggered in a checker board or waffle pattern. The groups or blocks with #1 and #3 floaters are gathered by the elastic yarns and form dimples, which enhance the gripping action. Since the band part 12 is single-ply, it does not tightly engage the wearer's leg. The positive floaters of the #1 and #3 yarns lie on the inside of the band part 12 and enhance the gripping ability.

Examples of yarns suitable for the band parts 10 and 12 are as follows:

Band part 10—2×3 double rib

#1—70/34 textured nylon (70,denier, 34 filaments),

#1—2650 doubled-covered "Lycra" (265 denier "Lycra" covered with two ends of 20 denier filament raw nylon),

#2—70/34 textured nylon

#3—70/34 textured nylon

#4—70/34 textured nylon

The #1 is a double feed.

Band part 12—4×4 block pattern

#1—2650 doubled-covered "Lycra" (265 denier "Lycra" covered with two ends of 20 denier filament raw nylon)

#2—70/34 textured nylon

#3—2434 single-covered "Lycra" (20 denier "Lycra" covered with one end of textured 40/34 nylon)

#4—70/34 textured nylon

The stocking may be made on a Lonati 404 machine. In forming the band part 10, the machine is set up and started with a standard make-up procedure recommended by the knitting machine manufacturer and then switched to a 2×3 needle selection, that is, two needles up and three needles down. This is done on feed #1 only, as a clear float selection, and is achieved by leaving the tuck cam and the clear cam in the in position. The portions of the #1 yarn that float behind the three needles that are down do not form knitted loops; the #1 yarn lays behind the needles. The two needles that are up form knitted loops. By using this selection, the segments of the #1 yarn that are not knitted into loops (form floaters) tend to draw together, which produces the ribbed effect, because it takes less yarn to pass behind the needles as floaters than it takes to form knitted loops. The 2×3 needle selection provides a fabric that tends to hold as well as the 1×1 and 2×2 needle selection fabrics, but with less #1 yarn and less constrictive power. Also, the rib effect gives a much softer, less binding feel to the band area. The 2×3 rib selection doubled over gives the garment a more finished appearance.

After knitting the 2×3 double rib band part with 2×3 needle selection for the #1 yarns and doubling it, a 4×4 positive float is selected for the #1 and #3 yarns of the single-ply 4×4 positive floater block pattern band part 12. The positive float selection is achieved by leaving the tuck cam in and bringing the clear cam out. By doing this, the needles that are down are taken out of action. There is no fabric on these needles at all. Therefore the #1 and #3 yarns that are floated in on this selection are not knitted into loops and lay unknitted or behind the needles. Therefore, they tend to draw together. By using this selection and alternating every four needles and every eight courses, an alternating drawing effect results in forming dimples that have a holding or gripping power comparable to 1×1 and 2×2 ribs that are doubled over, but with less #1 and #3 yarns and reduced constriction. By using the 4×4 block. pattern in a single-ply application, the floaters of the #1 and #3 yarns are exposed to the skins which helps in the holding quality of the top band; the "Lycra" yarns will grip the skin in the band area.

I claim:

1. A knitted stocking having a top band comprising at an end of the top band a first circumferentially extending part having a plurality of first courses of relatively less elastic yarns, each first course having needle loops in every wale, and a plurality of second courses of relatively more elastic yarns, each second course having alternately two needle loops in adjacent wales and three clear floaters in adjacent wales, there being at least one first course between each adjacent pair of second courses and the clear floaters of the second courses occurring in the same wales throughout the first part so as to form walewise ribs, and a second circumferentially extending part adjacent the first part and having a plurality of third courses of relatively less elastic yarns, each third course having needle loops in every wale, and a plurality of fourth courses of relatively more elastic yarns, each fourth course having alternately four needle loops in adjacent wales and four positive floaters in adjacent wales, the third and fourth courses alternating such that a fourth course lies between each adjacent pair of third courses, the needle loops and floaters of the fourth courses forming blocks of eight courses each in which the floaters of groups of adjacent fourth courses occur in the same wales in each block and the blocks being staggered in a uniform waffle pattern in the coursewise direction, the first part being doubled over and a free end of the first part being stitched to an end of the first part adjacent the second part.

2. A knitted stocking according to claim 1 wherein there are three first courses between each adjacent pair of second courses.

3. A knitted stocking according to claim 1 wherein the first courses are formed by three feeds of textured nylon yarn and the second courses are formed by one feed of a double-covered elastic yarn.

4. A knitted stocking according to claim 1 wherein the third courses are formed by two feeds of textured nylon yarn and the fourth courses are formed alternately by a feed of a double-covered elastic yarn and a feed of a single-covered elastic yarn, the double-covered elastic yarn having a denier substantially greater than that of the single-covered elastic yarn.

5. A knitted stocking according to claim 1 wherein the first band has a width of about ¾ inch.

6. A knitted stocking according to claim 1 wherein the second band has a width of about 1¼ inch.

7. A knitted stocking having a top band comprising a 2×3 double rib band part of a width of about ¾ inch having in alternation three adjacent courses of nylon yarn forming knitted loops in every wale and a 2×3 course of double-covered elastic yarn having in alternation two knitted loops and three clear floaters, the clear floaters in the 2×3 courses being in the same wales throughout the first part so as to form walewise ribs, and a 4×4 positive floater block pattern band part of a width of about 1¼ inch knitted to the double rib band part and having in alteration a course of nylon yarn forming knitted loops in every wale and a 4×4 course of covered elastic yarn forming in alternation four knitted loops and four positive floaters, the floaters forming a uniform pattern of blocks staggered coursewise in a waffle pattern, each block having four floaters in the same wales thereof.

8. A knitted stocking according to claim 7 wherein the three adjacent courses of the 2×3 double rib part are formed by 70/34 nylon yarns.

9. A knitted stocking according to claim 7 wherein the 2×3 courses of the 2×3 double rib part are formed by 265 denier "spandex" yarns covered with two ends of 20 denier filament raw nylon.

10. A knitted stocking according to claim 7 wherein the nylon yarns of the 4×4 positive floater block pattern band part are 70/34 nylon yarns.

11. A knitted stocking according to claim 7 wherein the covered elastic yarns of the 4×4 positive floater block pattern band part are alternately 265 denier "spandex" covered with two ends of 20 denier filament raw nylon and 20 denier "spandex" covered with one end of textured 40/34 nylon.

12. A knitted stocking having a top band comprising a 2×3 double rib band part of a width of about ¾ inch having in alternation three adjacent courses of 70/34 nylon yarn forming knitted loops in every wale and a 2×3 course of 265 denier spandex yarns covered with two ends of 20 denier filament raw nylon having in alternation two knitted loops and three clear floaters, the clear floaters in the 2×3 courses being in the same wales throughout the double rib band part so as to form walewise ribs, and a 4×4 positive floater block pattern band part of a width of about 1¼ inch knitted to the double band rib part and having repeatedly in succession a course of 70/34 nylon yarn forming knitted loops in every wale, a 4×4 course of 265 denier spandex covered with two ends of 20 denier filament raw nylon forming in alternation four knitted loops and four positive floaters, a course of 70/34 nylon yarn forming knitted loops in every wale and a course of 20 denier spandex covered with one end of 40/34 textured nylon, the positive floaters forming a uniform pattern of blocks staggered coursewise in a waffle pattern and each block having four floaters in the same wales thereof.

* * * * *